US005418020A

United States Patent [19]

Crane

[11] Patent Number: 5,418,020

[45] Date of Patent: May 23, 1995

[54] ADVERTISING DISPLAY

[76] Inventor: Stanley A. Crane, 520 Washington Blvd., #386, Marina Del Rey, Calif. 90292

[21] Appl. No.: 801,447

[22] Filed: Dec. 2, 1991

[51] Int. Cl.[6] ..... B65D 5/00

[52] U.S. Cl. ..... 428/12; 428/542.8; 446/488

[58] Field of Search ..... 40/124.1; 229/92.8; 428/12.9, 542.8, 7; 206/491; 446/448

[56] References Cited

U.S. PATENT DOCUMENTS

| | | | |
|---|---|---|---|
| 3,597,296 | 8/1971 | Lewis | 428/12 X |
| 3,690,620 | 9/1972 | Matson et al. | 428/12 X |
| 3,726,469 | 4/1973 | Koehler | 428/12 X |
| 3,975,223 | 8/1976 | Turoff | 428/913 X |
| 4,084,015 | 4/1978 | Patterson | 428/9 |
| 4,313,270 | 2/1982 | Volkert et al. | 428/12 X |
| 4,558,980 | 12/1985 | Sturdivan | 229/92.8 X |
| 5,000,717 | 3/1991 | Pfeiffer | 428/12 X |

*Primary Examiner*—Henry F. Epstein

*Attorney, Agent, or Firm*—Blakely, Sokoloff, Taylor & Zafman

[57] ABSTRACT

The present invention is a display formed of a printable medium such as paper, which comprises a substantially rectangular sheet having a front side and a back side, and a top substantially horizontal edge, a bottom substantially horizontal edge, a left substantially vertical edge and a right substantially vertical edge when viewing said front side of said sheet. The sheet is divided into four sections, a first section, a second section, a third section and a fourth section, each of which is substantially rectangular and extends from the top peripheral edge to the bottom peripheral edge. Each sections is disposed adjacent the next. Each of the first and second sections have a border along its periphery, said border being at least ½ inch in size in said border's shortest dimension, and at least one of said first and second sections having at least one hole confined to an area surrounded by said border. The sheet also has adhesive means for bonding the left vertical edge into adjacent relationship with said right vertical edge of the sheet. Also disclosed is a method for making a display.

5 Claims, 4 Drawing Sheets

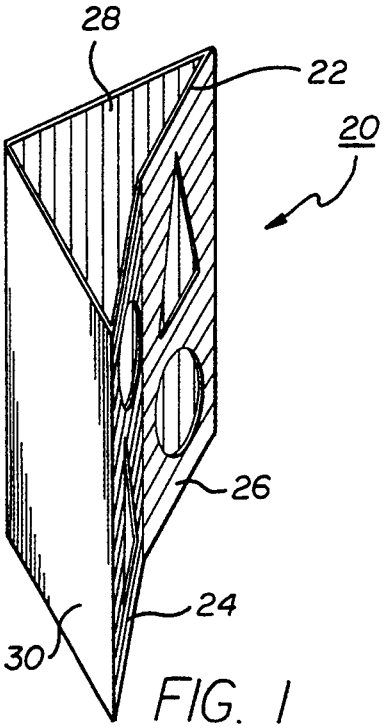
FIG. 1
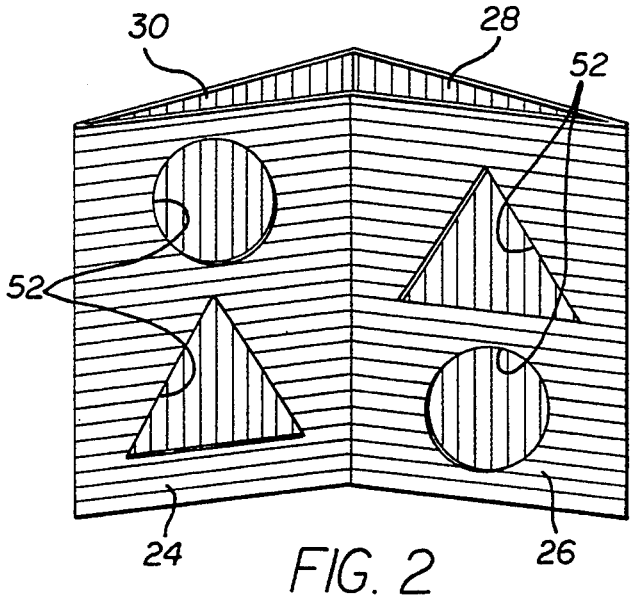
FIG. 2
FIG. 4
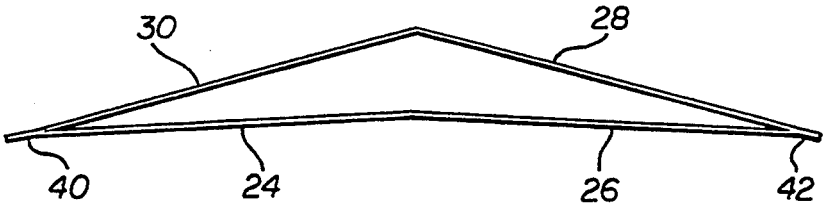
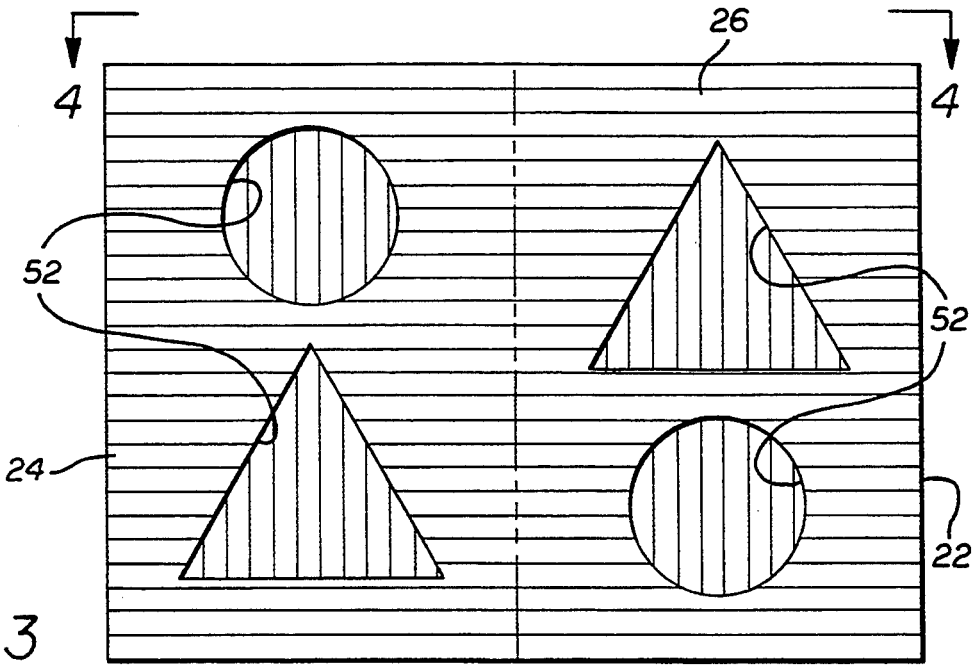
FIG. 3

FIG. 14
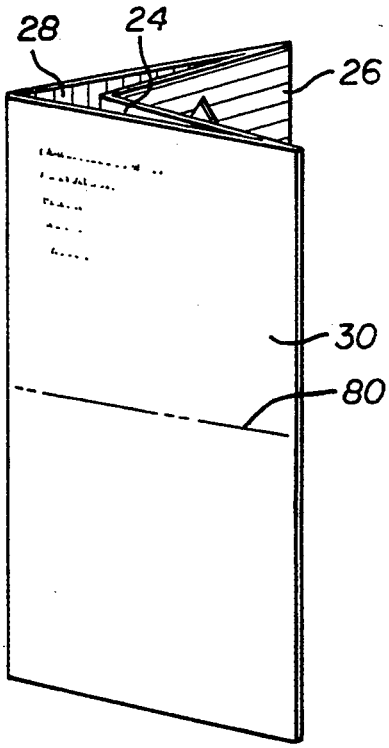
FIG. 15
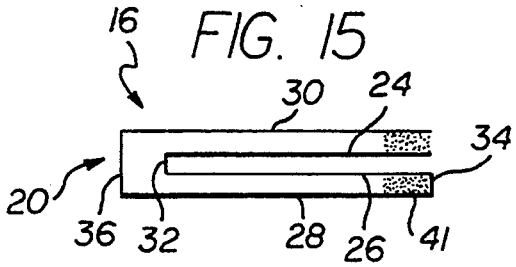
FIG. 16
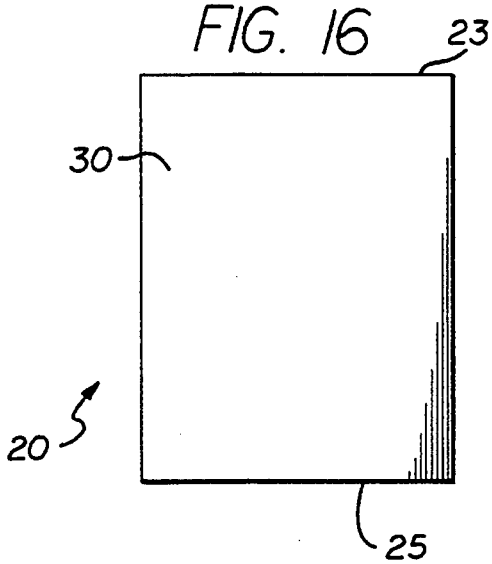
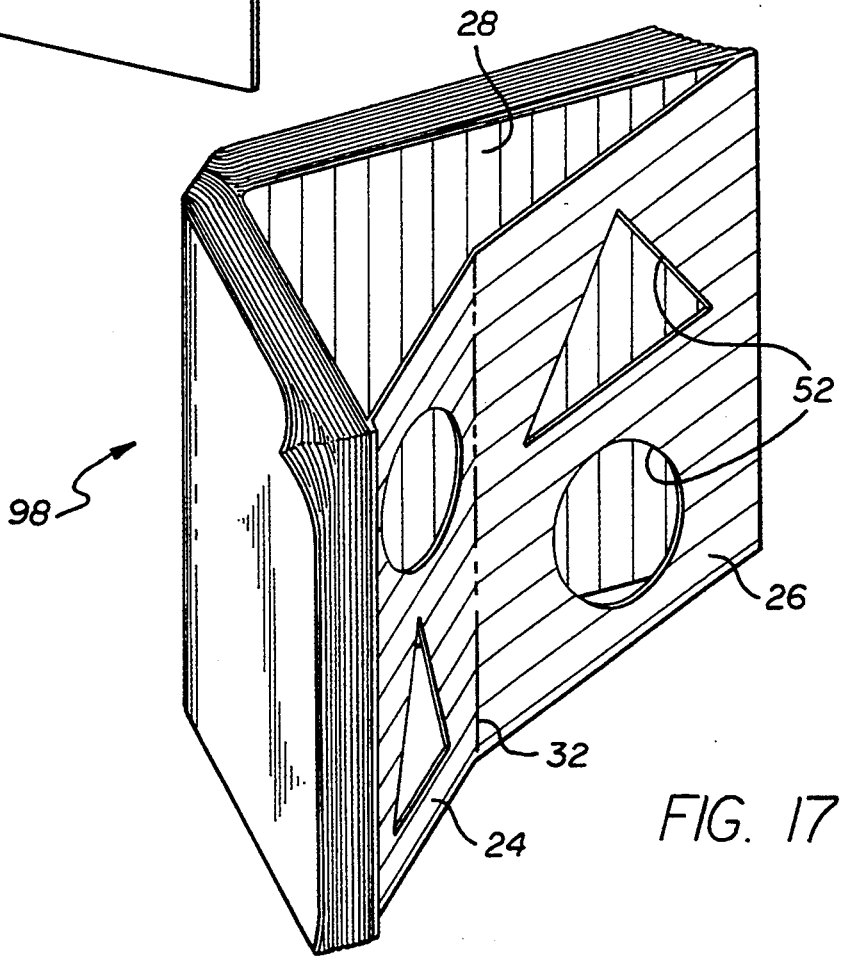
FIG. 17

ADVERTISING DISPLAY

BACKGROUND OF THE INVENTION

1. Field of the Invention

The invention relates to advertising displays, magazine inserts, direct mailers, gift cards, and souvenirs which may provide a three-dimensional effect and which are capable of being manufactured on modern high speed printing equipment.

2. Prior Art

The prior art comprises many advertising displays formed of paper, card stock and the like. As expressed in one of the prior art patents, U.S. Pat. No. 4,313,270 issued to Volkert et al., advertising hand-outs, inserts, mailers and the like are being used with greater and greater frequency to promote a particular product or service. Moreover, items of this general character are often used together with accompanying text in order to illustrate a particular theme or perhaps an incident in a story. Although the value of such an item as an illustration in a book or the like is obvious, its value in an advertising or promotional item lies in the recipient's attention which it hopes to gain. Accordingly, commercially practical items of this general type which incorporate attention-getting features remain in demand, along with way for mass-producing such items so as to make distribution economically feasible.

Many advertising items and inserts for books and magazines try to create a three-dimensional effect in order to capture the attention of the reader or prospective reader. However, none of the prior art creates a three-dimensional effect in the manner in which the present invention does, which effect can be used in conjunction with today's high speed printing equipment.

BRIEF SUMMARY OF THE INVENTION

The present invention is a display formed of a printable medium such as paper, which comprises a substantially rectangular sheet having a front side and a back side, and a top substantially horizontal edge, a bottom substantially horizontal edge, a left substantially vertical edge and a right substantially vertical edge when viewing said front side of said sheet in its unassembled form. The sheet is divided into four sections, a first section, a second section, a third section, and a fourth section, each of which is substantially rectangular and extends from the top horizontal edge to the bottom horizontal edge. Each sections is disposed adjacent to the next. Each of the first and second sections have a border along its periphery, said border being at least ½ inch in size in said border's shortest dimension (depending upon the tension set in the paper handling equipment used to cut and fold the paper), and at least one of said first and second sections having at least one hole confined to an area surrounded by said border. The sheet also has adhesive means for bonding the left vertical edge into adjacent relationship with said right vertical edge of the sheet.

BRIEF DESCRIPTION OF THE DRAWINGS

FIG. 1 is a perspective view of the invention in its assembled form as viewed from the front upper left of the assembled invention.

FIG. 2 is a perspective view of the invention in its assembled form as viewed from above and in front of the assembled invention.

FIG. 3 is a front view of the invention in its assembled form.

FIG. 4 is a top view of the invention in its assembled form taken along line 4—4 of FIG. 3.

FIG. 14 is a perspective view of the sheet of paper of FIG. 13 after its edges have been glued by state of the art modern paper handling equipment.

FIG. 15 is a bottom end view of the present invention after it has been folded and stacked by state of the art modern paper handling equipment.

FIG. 16 is a front view of the invention taken along line 16—16 of FIG. 15.

FIG. 17 is a perspective view of the present invention when used as a magazine insert, with the magazine shown opened at the present invention, as viewed from the top, left front of the assembled invention.

DETAILED DESCRIPTION OF THE INVENTION

Figure 5:
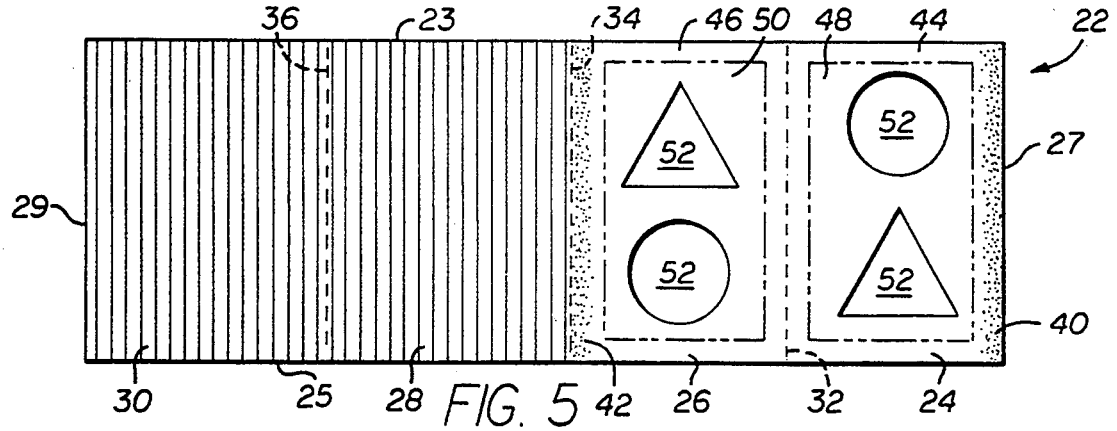
FIG. 5 is a top a view of the back side of the invention in its unassembled form.

The preferred embodiment of the subject invention is illustrated in the attached drawings which are referred to herein. The same reference numeral will be used to identify identical elements throughout the drawings.

With respect to FIGS. 1-6, the invention 20 can be seen as formed of a single sheet 22 of paper (or card stock or other similar material or medium capable of being printed upon) having a generally rectangular shape with left vertical edge 27, top edge 23, right vertical edge 29 and bottom edge 25. (See FIG. 6.) Sheet 22 is comprised of four sections, a first section 24 adjacent the left vertical edge, a second section 26 adjacent the first section, a third section 28 adjacent the second section, and a fourth section 30 adjacent the third section. The right vertical edge is adjacent the fourth section. Fold creases (represented by dashed lines) 32, 34 and 36 are disposed between the first and second sections, the second and third sections, and the third and fourth sections, respectively.

With specific reference to FIG. 5, the "back side" of the sheet 22 is shown. Adhesive bearing areas 40 and 42 (represented by the stippled areas) are used to hold adhesives typically used to bond pieces of paper to each other. The first adhesive bearing area 40 is disposed on the back of the first section along the left vertical edge 27 (shown on the right in FIG. 5) of sheet 22. The second adhesive bearing area 42 is disposed on the back of the second section along crease 34.

Adjacent the periphery of each of the first and second sections is a border referred to herein as the "integrity border." The first integrity border, designated by reference numeral 44, includes the first adhesive bearing area 40 and surrounds a substantially rectangular first dispensable area 48 shown in FIG. 5 as the portion of first section 24 bounded by phantom lines. Second integrity border 46 includes the second adhesive bearing area 42 and surrounds substantially rectangular second dispensable area 50 shown as the portion of second section 26 within the phantom lines.

Integrity borders 44 and 46 are integral and coextensive with each other. Dispensable areas 48 and 50 are those portions of the first and second sections which may be removed to help create a three-dimensional display as more fully discussed below. In the illustrated example, cutouts 52 have been removed from the dispensable areas. No portions of the integrity borders should be removed.

The first and second sections are approximately equal in size to each other.

Third and fourth sections 28 and 30 are also approximately equal in size to each other, and the third and fourth sections are wider (measuring from left to right in FIG. 5) than the first and second sections. (Regardless of whether the first and second sections are equal in size to each other or whether the third and fourth sections are equal in size, the overall width of the third and fourth sections should be greater than the overall width of the first and second sections.)

The third and fourth sections form the background portion of the display of the present invention. As shown in FIG. 5, a background design is imprinted on the back side of the third and fourth sections of sheet 22. In this example the background design is indicated by a series of vertical lines.

Figure 6:
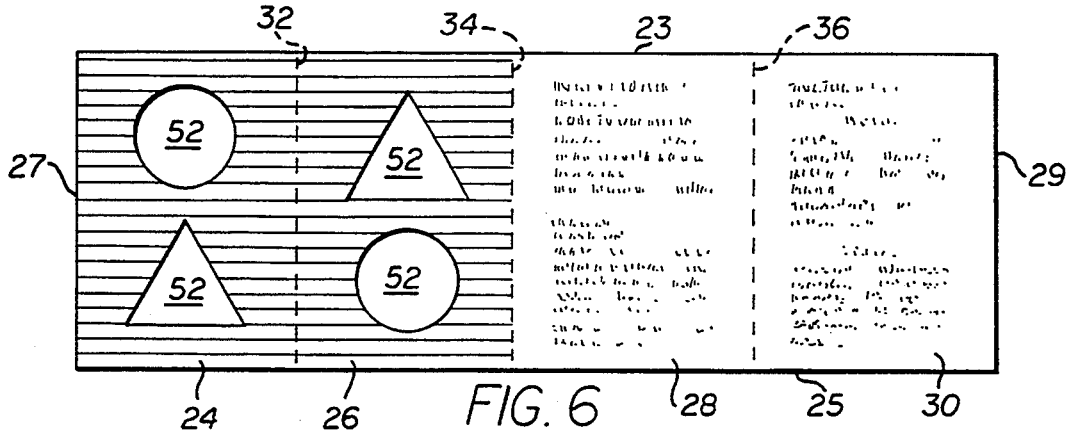
FIG. 6 is a top view of the front side of the invention in its unassembled form.

With reference to FIG. 6, the "front side" of sheet 22 is shown. First and second sections 24 and 26 have the foreground design printed thereon, which in the illustrated example, is a series of horizontal lines, except of course for cutouts 52.

The front side of the third and fourth sections 28 and 30 may be left blank (as shown in FIG. 1) or may have text (as shown in FIG. 6) or may have drawings, photographs or the like printed thereon. The matter printed on the front side of the third and fourth sections may relate to the subject matter of the display, or may relate to other subject matter depending upon the context in which the display is placed.

The display of the present invention is formed by folding the back side of the first and second sections over the back side of the third and fourth sections along crease 34 and extending left vertical edge 27 (which is adjacent the first section 24) into alignment with the right vertical edge 29 (which is adjacent the fourth section 30). Adhesive disposed along adhesive bearing area 40 binds the vertical edges together in "face to face" relation. Adhesive disposed along adhesive bearing area 42 is actually not necessary, but it does provide greater strength to the structure of the display when it binds the back side of the extreme right portion of the second section to the back side of the extreme left portion of the third section on either side of crease 34 (with left and right directions being understood to refer to those directions as they appear in FIG. 6).

The assembled display of the present invention is shown in FIGS. 1–4. When a reader sees the open display, the distance between the first and second sections (which are closer to the reader) on the one hand, and the third and fourth sections on the other hand, gives the distinct impression of viewing something in three dimensions. That impression is enhanced as the display is moved relative to the reader's eyes, since the relationship between the foreground and background illustrations will change as the viewer's perspective changes. In the example shown in FIGS. 1–4, the appearance is created of waves appearing off in the distance behind holes in surface shaded with horizontal lines.

Other images could be used of course, such as an automobile in the foreground (printed on the front side of the first and second sections) and mountains in the background (printed on the back side of the third and fourth sections), with everything cut out of the dispensable areas 48 and 50 except the portions needed to complete the illustration of the automobile.

Figure 7:
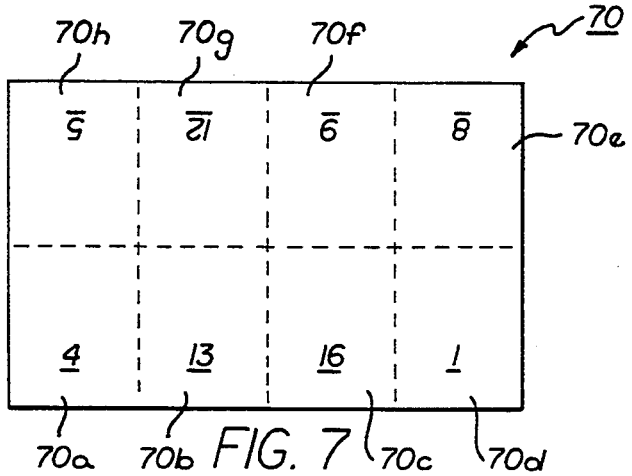
FIG. 7 is a front view of a sheet of paper in the beginning of processing on state of the art modern printing and paper handling equipment.

The present invention is adapted to be manufactured on high speed state of the art modern printing and handling equipment. It is helpful to understand how paper is handled on modern state of the art equipment. Using magazines as an example, high speed printing and handling machines operate as follows. Assuming that the final size of the magazine will be $8\frac{3}{8}$ inches in width and $10\frac{3}{4}$ inches in height, giant rolls of paper 35 inches in width and hundreds of feet long are mounted on the printing equipment. The leading edge of the paper is threaded into and pulled through the machinery where the magazine's editorial copy, advertising and other contents are printed on both sides of the paper. Typically, magazines are printed in segments, known in the publishing trade as "signatures," 16 pages at a time. With reference to FIG. 7, sheet 70 comprising a 16 page signature is shown. The signature has been cut so that its height is 22 inches and its width is still 35 inches from left to right. It is printed on both sides of the paper with pages 1–16 printed in the pattern which is partially shown in FIG. 7. Pages 1 and 2 are printed on the front and back sides, respectively, of section 70*d*. Pages 4 and 3 are printed on the front and back sides, respectively, of section 70*a*. Pages 5 and 6 are printed on the front and back sides, respectively, of section 70*h*. Page 8 and 7 are printed on the front and back sides, respectively, of section 70*e*. Pages 9 and 10 are printed on the front and back sides, respectively, of section 70*f*. Pages 12 and 11 are printed on the front and back sides, respectively, of section 70*g*. Pages 13 and 14 are printed on the front and back sides, respectively, of section 70*b*. Pages 16 and 15 are printed on the front and back sides, respectively, of section 70*c*. Each section in the example is bounded by the dashed lines in FIG. 7 and the peripheral edges of the sheet. Each section is $8\frac{1}{2}$ inches wide and 11 inches high.

Figure 8:
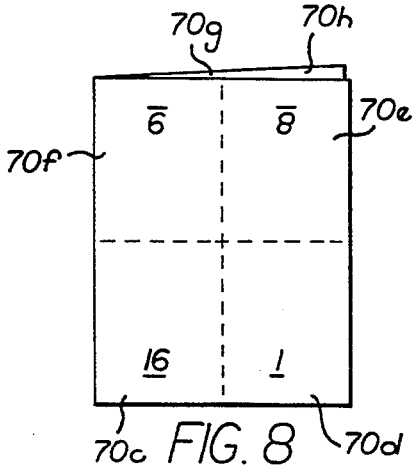
FIG. 8 is a perspective view of the sheet of paper of FIG. 7 after it has been partially folded by state of the art modern printing and paper handling equipment.

The printing and handling equipment has wire-like arm members which fold the sheet in half three times. The first fold is illustrated in FIG. 8, and is accomplished by folding sheet 70 so that the back sides of sections 70*a*, 70*b*, 70*g* and 70*h* are brought into face to face relationship with the back sides of sections 70*d*, 70*c*, 70*f* and 70*e*, respectively.

Figure 9:
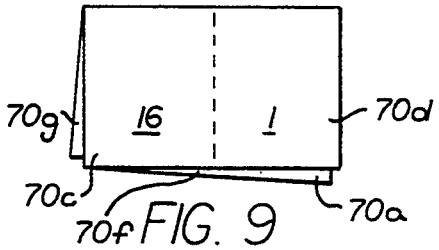
FIG. 9 is a perspective view of the sheet of paper of FIG. 8 after it has been further partially folded by state of the art modern printing and paper handling equipment.

The second fold is illustrated in FIG. 9, and is accomplished by bringing the front sides of sections 70*a* and 70*b* into face to face relationship with the front sides of sections 70*h* and 70*g*, respectively.

Figure 10:
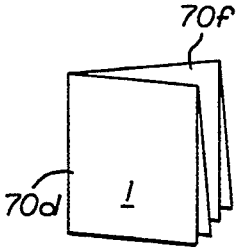
FIG. 10 is a perspective view of the sheet of paper of FIG. 9 just as it is being completely folded by state of the art modern printing and paper handling equipment.

The third and final fold is illustrated in FIG. 10, and is accomplished by bringing the front side of section 70*e* into face to face relationship with the front side of section 70*f*.

In the signature shown in the example of FIG. 10, page 1 forms the front of the signature. The equipment completes pressing the signature down so that it is flat. The creases aligned vertically along the left side of the signature shown in FIG. 10 form the "spine." The creases aligned horizontally along the top form the "head" of the signature. The creases and edges aligned vertically along the right side of the signature shown in FIG. 10 form the "face." The edges aligned horizontally along the bottom of the signature form the "foot" of the signature.

The head, face and foot of the signature are then trimmed so that two things are accomplished; (1) the creases aligned at the head and face of the signature are trimmed away so that each section of sheet 70 is no longer attached to the other sections, except at the spine, and (2) the edges are made smooth.

All the signatures of the magazine are then stacked on top of each other and bound at their spines in a cover and backing to form the magazine.

By printing the magazine in signatures, a publisher can have different segments inserted which can be special segments or segments intended to be sent to specific markets.

Figure 11:
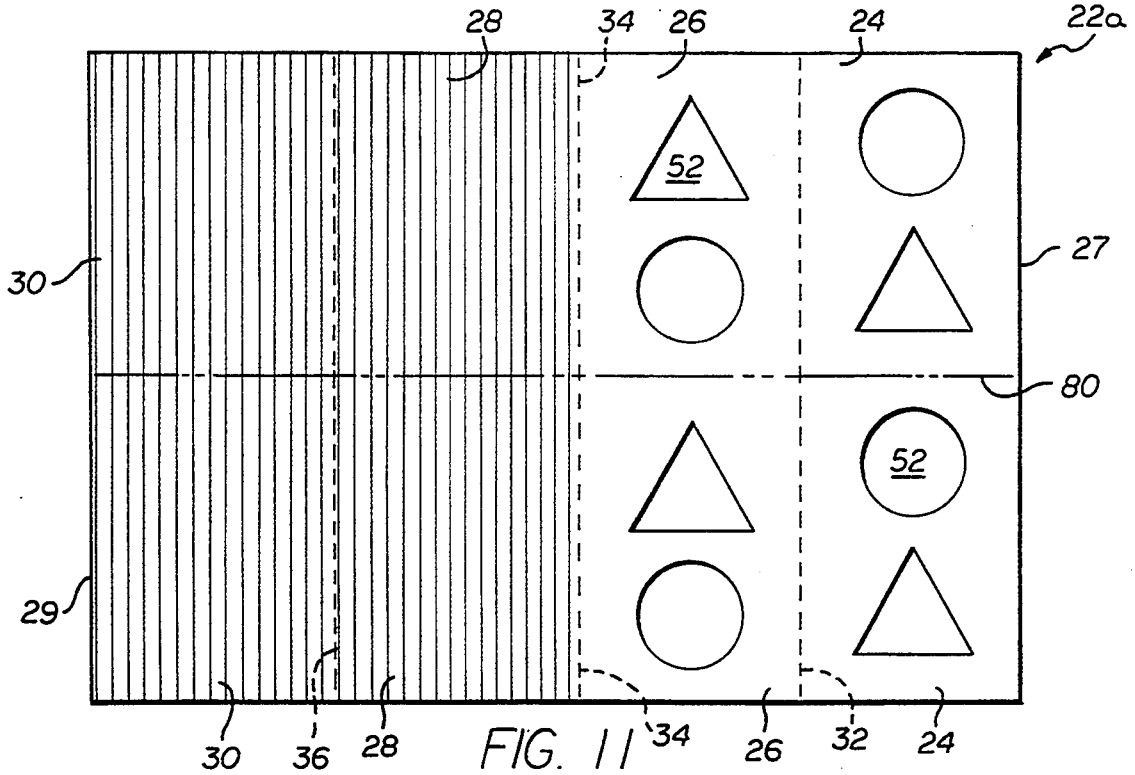
FIG. 11 is a back view of a sheet of paper comprising two units of the present invention as it appears as it is about to be folded on paper handling equipment.

When the present invention is printed and folded on modern high speed printing and handling equipment, it is printed in duplicate on sheet 22*a*, or a "two-up" format, as shown in FIG. 11. The equipment performs the function of making the cutouts and applying adhesive on the adhesive bearing areas, as described earlier in connection with Fig. 5. (It is evident that the adhesive bearing areas could be on the appropriate portions of the back side of the third and fourth sections instead of the back side of the first and second sections.)

Figure 12:
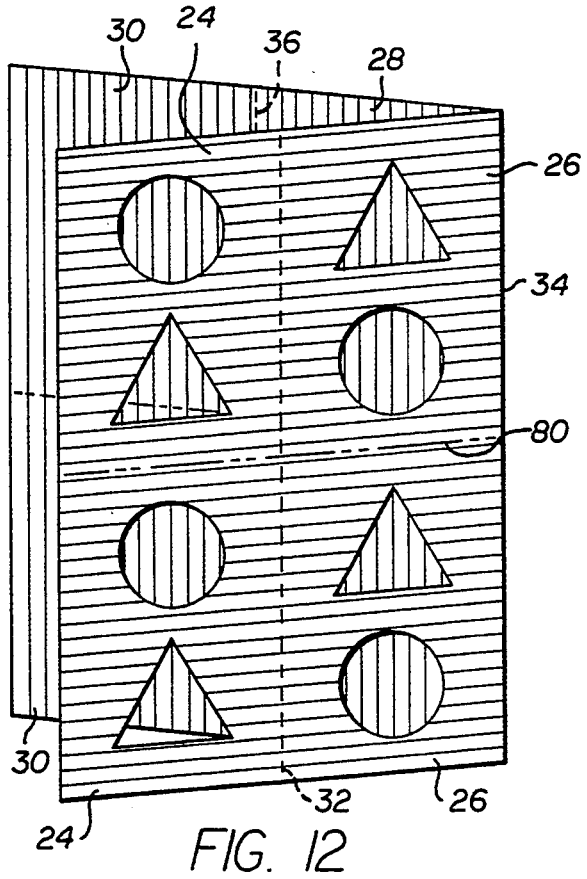
FIG. 12 is a perspective view of the sheet of paper of FIG. 11 after it has been partially folded by state of the art modern paper handling equipment.
Figure 13:
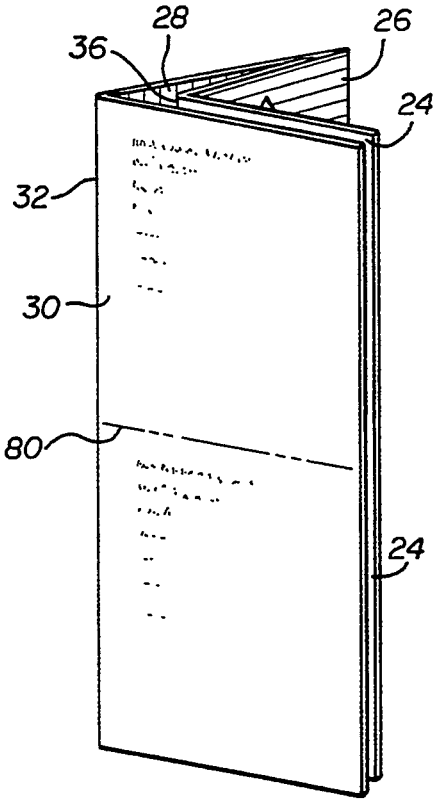
Figure 13 is a perspective view of the sheet of paper of FIG. 12 as it is being completely folded by state of the art modern paper handling equipment.

The first fold is made, as shown in FIG. 12, along crease 34 so that the back sides of sections 24 and 26 are put in face to face relationship with the back sides of sections 30 and 28, respectively. Folds are then made along creases 32 and 36 as shown in FIG. 13. The vertical edges 27 and 29 are then positioned so that they may be glued together to form the configuration shown in FIG. 14.

The display is then folded into a mini-stack as shown in FIG. 15, with creases 32 and 36 shown in exaggerated fashion. This mini-stack is cut in half along cut line 80 (shown in FIGS. 11–14), and then each display exists in "one-up" format, shown in FIG. 16. Cut line 80 forms bottom edge 25 for half the displays and top edge 23 for the other half of the displays. If the display is intended to stand alone (as for example as an insert into newspapers), then the top edge 23 and bottom edge 25 (see FIG. 16) may be trimmed or not depending upon the manufacturer's pleasure. So long as adhesive has been disposed adjacent crease 34, the right most edge of the display as viewed in FIG. 16 (which includes edges 27 and 29 and crease 34) may also be trimmed. And, if the display is to be a segment in a magazine, all four edges will be trimmed, with the crease 36 trimmed off and the adjacent portions of the third and fourth sections being attached to the binding edge of a "perfect bound" magazine 98, as shown in FIG. 17.

When the display of the present invention is assembled on modern printing and paper handling equipment as used in the magazine publishing industry (as well as other industries) there must be sufficient material immediately adjacent the common border of the first section 24 and second section 26 (i.e., crease 32) for the equipment to work against, particularly during the paper folding step. Therefore, each of the integrity borders 44 and 46 should be approximately ½ inch wide on the areas adjacent creases 32 and 34 and left vertical edge 27, and preferably at least ½ inch in size in that dimension. Similarly, the integrity borders should be approximately ½ inch in height adjacent top and bottom edges 23 and 25. In some instances, the borders may need to be 1 inch in their shortest dimension, or greater.

A unique display device has been described above. It will be understood that various changes of the details, materials, steps, arrangement of parts and uses which have been herein described and illustrated in order to explain the nature of the invention will occur to and may be made by those skilled in the art, and such changes are intended to be included within the scope of this invention.

I claim:

1. A display formed of a printable medium comprising:

a substantially rectangular sheet having a front side, and back side, a top substantially horizontal edge, a bottom substantially horizontal edge, a left substantially vertical edge, and a right substantially vertical edge when viewing said front side of said sheet in unassembled form, said sheet further having a first section, a second section, a third section and a fourth section, each of said first, second, third and fourth sections being substantially rectangular and extending from said top horizontal edge to said bottom horizontal edge, said first section disposed adjacent said left vertical edge, said second section disposed adjacent and to the right of said first section, said third section disposed adjacent and to the right of said second section, said fourth section disposed adjacent and to the right of said third section, with said right vertical edge disposed adjacent and to the right of said fourth section, said sheet further having a first fold crease disposed between said first and second sections, a second fold crease disposed between said second and third sections, and a third fold crease disposed between said third and fourth sections, with each of said first, second, and third fold creases extending from said top edge to said bottom edge of said sheet; each of said first and second sections having a border along its periphery, said border having a border shortest dimension measuring at least ½ inch in size, and at least one of said first and second sections having at least one hole confined to an area surrounded by said border, said sheet further having adhesive means for bonding said left vertical edge into adjacent relationship with said right vertical edge.

2. The display of claim 1 wherein said border shortest dimension measures at least 1 inch in size.

3. The display of claim 2 wherein each of said first and second sections have a hole confined to said area surrounded by said border of that respective section.

4. The display of claim 3 wherein the arithmetical sum of the horizontal width of said third and fourth sections is greater than the arithmetical sum of the horizontal width of said first and second sections.

5. The display of claim 4 wherein the horizontal width of said third section is equal to the horizontal width of said fourth section.

* * * * *